United States Patent [19]

Wong

[11] Patent Number: 5,051,068

[45] Date of Patent: Sep. 24, 1991

[54] COMPRESSORS FOR VEHICLE TIRES

[76] Inventor: Alex Y. K. Wong, Room 501, Hong Kong Worsted Mills Industrial Building, 31-39 Wo Tong Tsui Street, Kwai Chung, N.T., Hong Kong

[21] Appl. No.: 567,963

[22] Filed: Aug. 15, 1990

[51] Int. Cl.[5] ..... F04B 21/00; F04B 17/00

[52] U.S. Cl. ..... 417/234; 417/313; 417/410

[58] Field of Search ..... 417/234, 313, 410

[56] References Cited

U.S. PATENT DOCUMENTS 4,830,579 5/1989 Cheng ..... 417/234

*Primary Examiner*—Leonard E. Smith
*Assistant Examiner*—Alfred Basichas
*Attorney, Agent, or Firm*—Fredrikson & Byron

[57] ABSTRACT

A portable compressor of the tire in which an electrically powered compressor is housed in a case. The case having a hinged plug capable of being connected to and having fixed thereto by the connection a portable light fitting. The light fitting having permanently attached to it a length of electrical cord with a plug for temporary attachment to the cigar lighter of a vehicle to draw power from the vehicle's electrical system. The light fitting including an outlet socket to which the hinged plug can be connected for electrical connection of the electrically powered compressor and for fixing and supporting the light fitting on the case. The hinging of the plug allowing it and the light fitting when attached to it to be folded flat to the case for storage, and the light fitting to be upstanding from the case to illuminate the region of the case. When the light fitting is removed from the plug, however, it can be used as a portable light fitting independent of the case.

6 Claims, 6 Drawing Sheets

FIG. 6
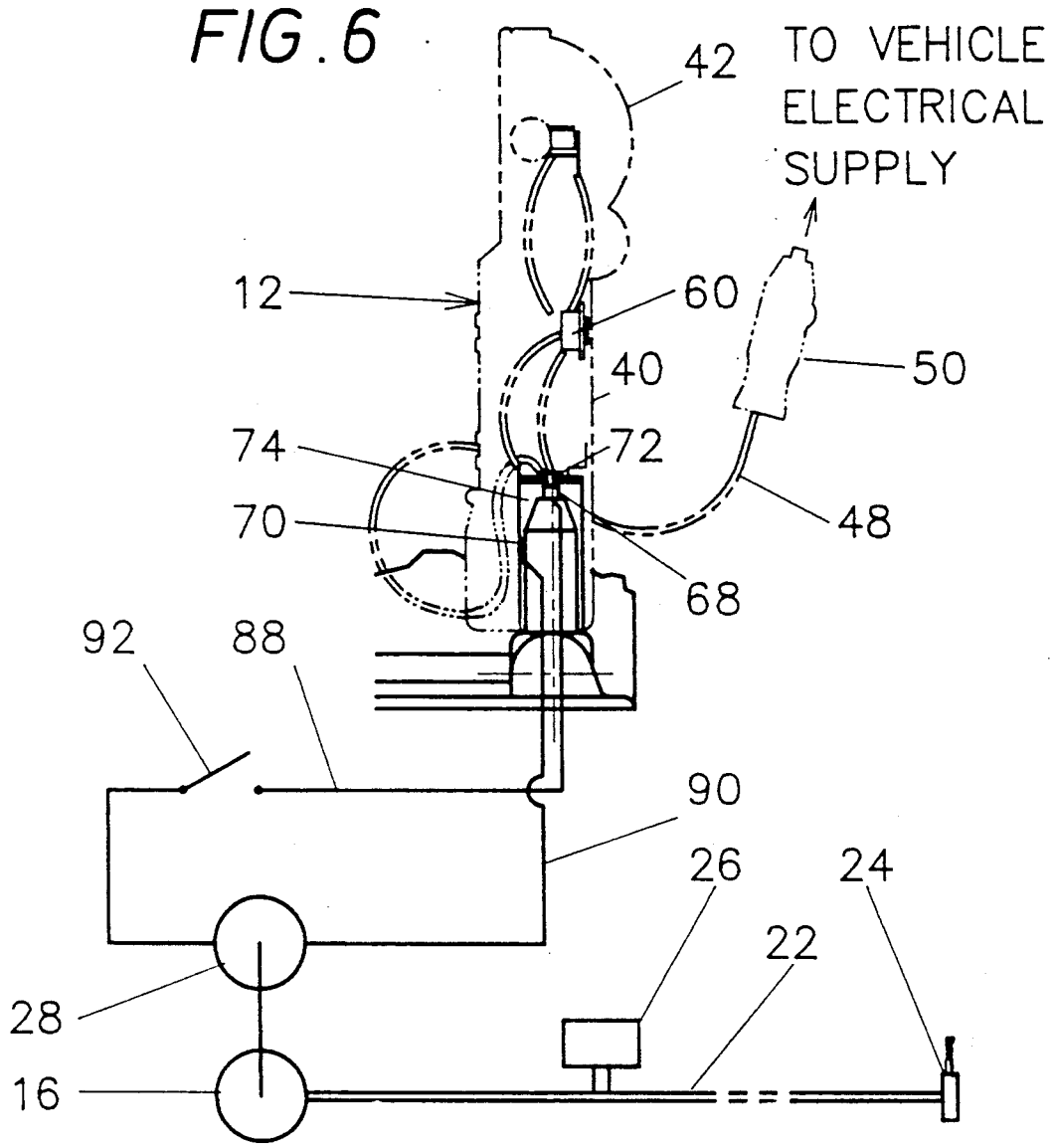
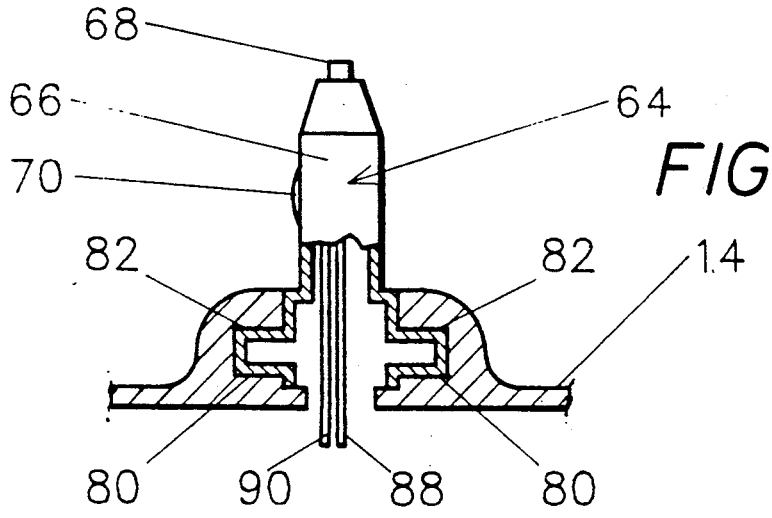
FIG. 7

COMPRESSORS FOR VEHICLE TIRES

This invention relates to improvements in portable compressors for items such as vehicle tires. In particular the invention relates to compressors of the type where compressor is housed in a compact case and can be powered from the vehicle's own electrical system, e.g. by being plugged into a cigar lighter socket by a length of electrical cord extending from the case.

Also for convenience the compact case is desirably in the form of a rectangular parallelopiped shaped piece of luggage with a hinged lid enabling the case to be shut to protect and house the compressor and its associated equipment when not in use and to be opened to enable the compressor to be used.

BACKGROUND TO THE INVENTION

In one previous compressor of this general type a length of electrical cord is permanently affixed to the case at one of its ends and at the other end it has a socket which can be plugged into the cigar lighter of a vehicle dashboard. The compressor has an air hose which can be attached to the inflation valve of a tire. The compressor is then operated to inflate a tire as required.

According to one improvement an illuminating light is built into the case and mounted on the end of a hinged arm which can be raised from the case to provide general illumination of the working area.

According to a further arrangement which is described in U.S. Pat. No. 4,830,579, the illuminating light is removable from the end of the hinged arm and so is the said one end of the electrical cord from the case. That said one end can then be attached directly to the light so that the light can be used separately from the compressor and case. A problem with such an arrangement is, however, that the compressor cannot be used remotely from the light since, as soon as the cord is attached directly to the light, the compressor becomes disconnected from the electrical source. One cannot, therefore, use the light as a warning hazard light positioned at the rear of a vehicle whilst using the compressor to inflate say the near side front tire of a vehicle.

It is therefore an object of this invention to provide an improved arrangement for a portable compressor of this type where the light can be used separately from the case yet at the same time the compressor can be independently operated.

BRIEF SUMMARY OF THE INVENTION

According to the invention there is provided a portable compressor of the type comprising an electrically powered compressor having an air hose and housed in a case and connectable by an electric cord to the electrical system of a car, in which the said electric cord has one end connectable to a vehicle's electrical system and its other end permanently attached to a portable light fixture comprising a hand-held portion and a head portion housing the light, the hand-held portion including an outlet socket, and the case having a hinged arm capable of folding flat within the case when the case is to be shut and being upstanding to support the said portable light fixture, the hinged arm having an end comprising an electrical plug capable of being received in the socket of the portable light fixture both to fix and support the light fixture on the end of the said arm and to electrically connect the light fixture to the case, the electrical plug being electrically connected to power the compressor.

According to a preferred embodiment of the invention an additional length of electrical cord is provided and one end has a socket which can fit with the plug on the end of the arm hinged to the case, whilst the other end has a plug which can fit within the socket of the hand-held portion of the portable light. Then it is possible to use the light fixture remotely from the compressor and its case yet still have the compressor electrically powered from the electrical system of the vehicle. As an alternative the socket at the end of the additional length of cord can be attached to other vehicle accessory equipment such as a flashing warning light, a vacuum cleaner and so on, instead of being attached to the arm on the case, provided, of course, that this equipment has a suitable input plug to be received in the socket.

With such an arrangement one can achieve a far better flexibility of usage for the light and compressor since the compressor can be positioned and used where needed adjacent a tire yet the light can be moved around as required for illumination, whether of the region of the tire or elsewhere.

The shape and configuration of the various plugs is preferably based on the design of a conventional plug used temporarily to connect an electrical accessory to the cigar light socket on a vehicle dashboard. Such plugs are very well known and generally comprise a cylindrical shaped insulating body which can fit into the socket and, at the front end, a resiliently depressible central contact constituting a first electrical contact and a resiliently depressible side contact extending substantially radially out from the side of the cylindrical shaped body to constitute a second electrical contact.

The socket such as in the hand-held portion of the light fixture can then be designed to receive such a plug and make a good electrical connection.

The case is desirably of rectangular parallelopiped shape with a hinged lid. The compressor is permanently fitted within the case and the hinged arm capable of being laid flat when the case is to be shut. Also it is desirable that a storage space to be provided by the case for the storage of the light fitting when not in use, preferably when it is mounted on the arm and the arm is folded flat with the case.

DESCRIPTION OF THE DRAWINGS

The invention will now be described, by way of example, with reference to the accompanying drawings, in which:

FIG. 6 is a circuit diagram showing the electrical connections;

FIG. 7 is a sectional detail taken along the line 7—7 of FIG. 4.

DESCRIPTION OF THE PREFERRED EMBODIMENT

Figure 1:
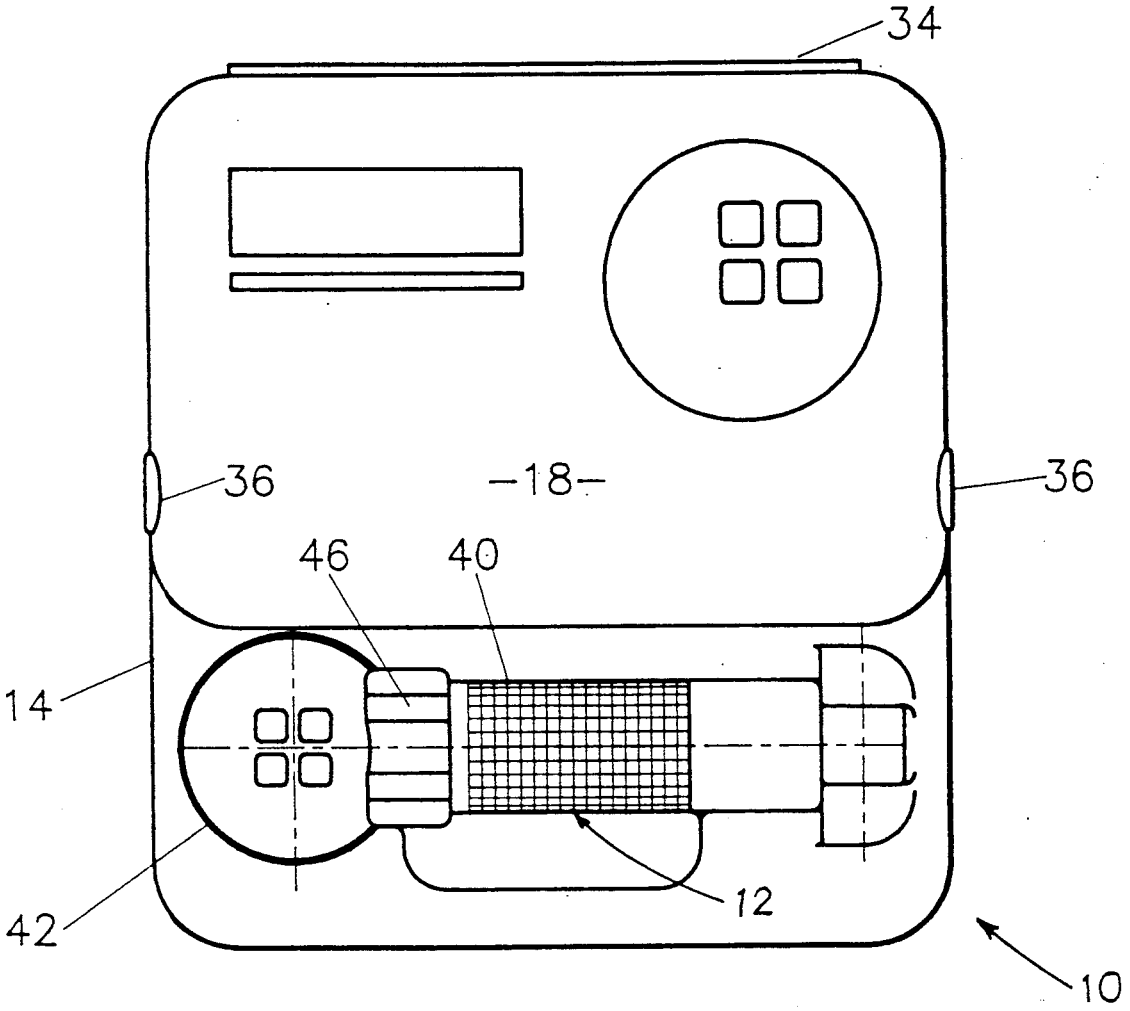
FIG. 1 is a plan view of a portable compressor unit according to the invention with the case shut.

The combined portable compressor and lamp arrangement 10 shown in the drawings includes a hand-held lamp 12 and a case 14 in which is positioned an electrically driven compressor 16. The case houses the compressor 16 and has a lid 18 and the lamp 12 can be attached to the case 14 as will be described.

The compressor 16 is entirely conventional and supplies pressurized air to a flexible outlet tube 22 having at its free end a fitting 24 of conventional design for connection to inflate a pneumatic tire. A pressure gauge 26 is housed in the case 14 to give the user an output pressure reading. The compressor 16 is driven directly by an electric motor 28 also mounted in the case capable of working off the electrical supply of a vehicle as will be described. The case 14 has a small compartment 30 for a number of differently shaped fittings 32 to adapt the fitting 24 to be used with various tires and other uses.

The lid 18 is connected to the case 14 by means of a strip 34 of synthetic plastics material which acts as a hinge. The lid has integrally formed clips 36 which engage with recesses 38 on the case to hold the lid in the closed position shown in FIG. 1 where the lid covers and protects the compressor 16, the tube 22, gauge 26 and motor 28 so that the arrangement 10 can be safely stored in say the trunk of a car.

Such an arrangement is largely conventional and is not felt to require any further description since arrangements of this general type are well known.

The lamp 12 itself comprises a hand-held portion 40 and a lamp unit 42 which houses a conventional electric bulb 44 and reflector (not shown). Although not shown in detail the unit 42 can be hinged to the portion 40 about a hinge 46.

Permanently attached to the portion 40 is a length of electrical cord 48 and at its free end the cord has a plug 50. This is of conventional construction and is capable of being attached to the cigar lighter on a vehicle dashboard to enable the lamp 12 to be connected to and powered by the electrical system of a vehicle.

Such plugs are conventional and widely used for attaching portable electrical equipment to a vehicle's electrical supply so as to be driven therefrom. The plug includes a cylindrical shaped body 52 of insulating material and of a size to fit within the cigar lighter, a central resiliently mounted first contact 54 at its outer end and a radially and resiliently mounted second contact 56. The first and second contacts will engage with the electrical components in the cigar lighter and provide power to the cord 48 whose electrical wires are respectively attached to these first and second contacts 54 and 56.

The portion 40 has a recess 57 (FIG. 2) in which the plug 50 can be received for storage when not in use.

Figure 8:
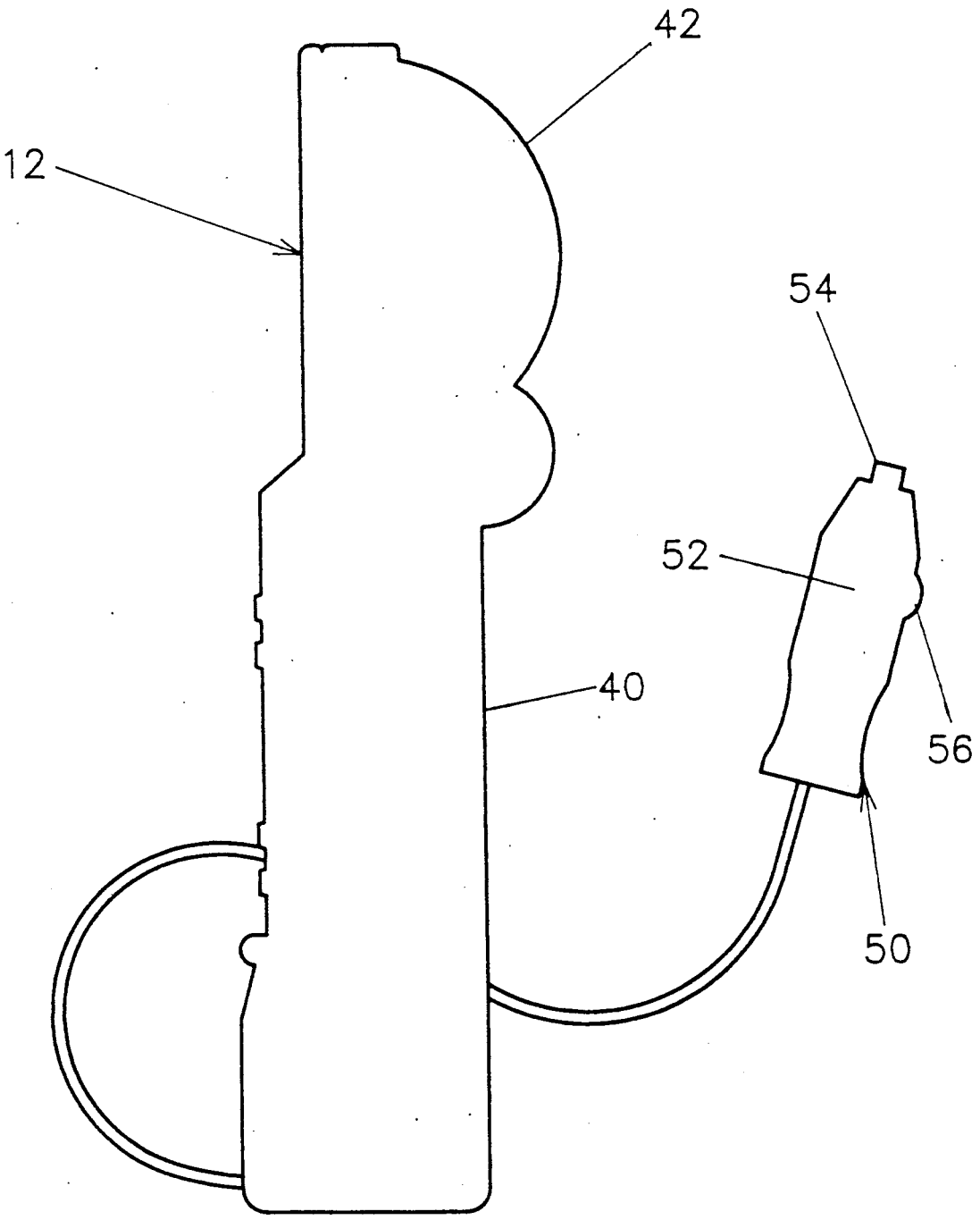
FIG. 8 is a view of the lamp on its own removed from the case.

As will be described the lamp 12 can be separated from or attached to the case 14. When it is separated as shown in FIG. 8 and the plug 50 attached to a vehicle's cigar lighter, it is powered from the electrical system, e.g. the battery, of the vehicle and then its bulb 44 can be illuminated to provide a portable light, e.g. as required in an emergency to locate a problem such as a deflated tire. The activation of the light can be controlled by an on/off slide switch 60.

Within the lower end of the portion 40 is a cylindrical opening 62 constituting a socket. This is of a size capable of receiving a plug 64 mounted on the case, the plug 64 being, apart from its mounting on the case 14, substantially the same as the plug 50. Thus the plug 64 has a cylindrical insulating portion 66, a central resiliently mounted contact 68 and a resiliently mounted radial contact 70.

Figure 5:
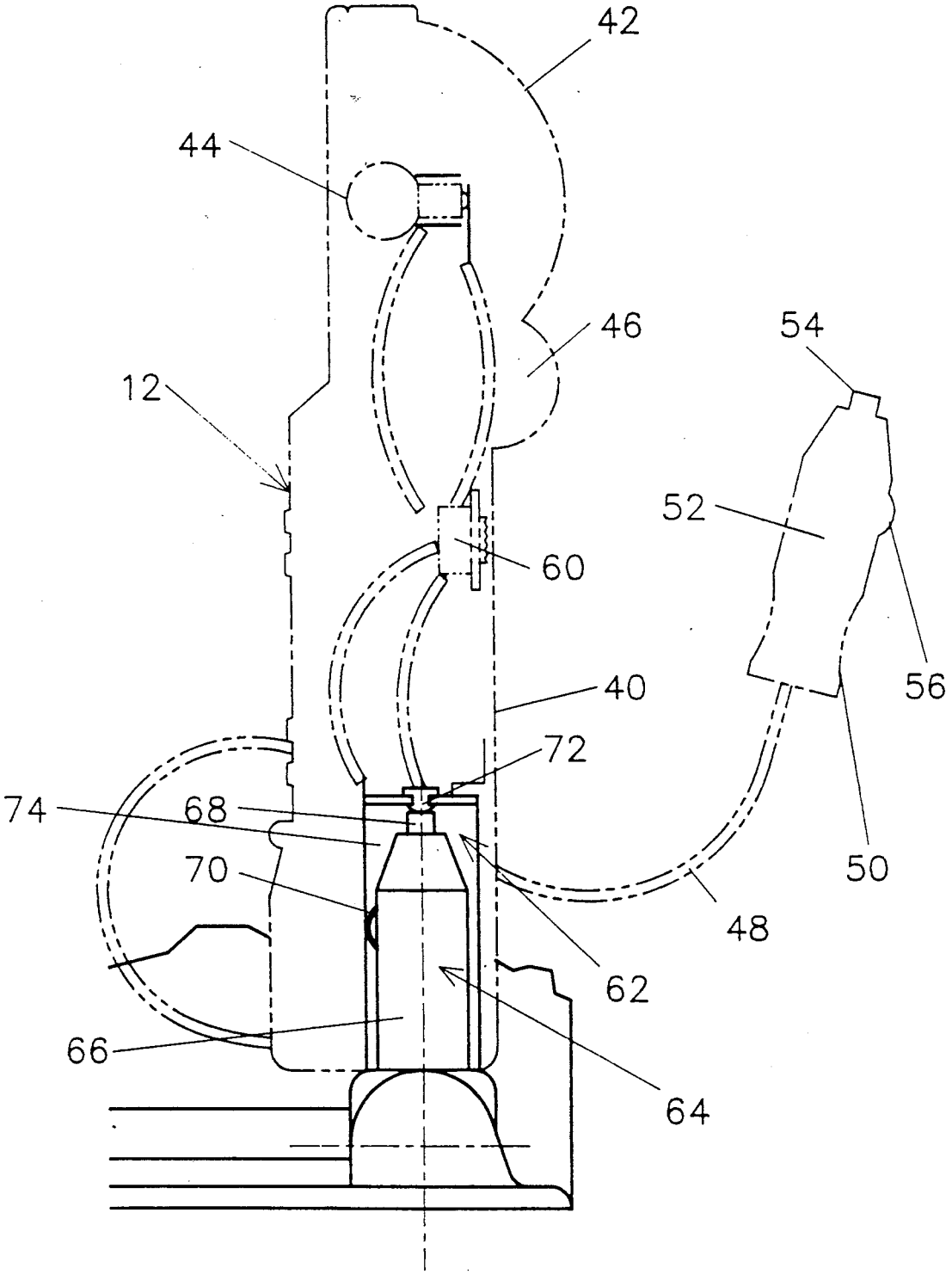
FIG. 5 is an enlarged detail showing the connection of the lamp to the case.

As best seen in FIG. 5, the portion 40 has at the top of the opening 62 a central contact stud 72 which is connected to one of the electrical leads in the cord 48 and a cylindrical contact sleeve 74 to which the other of the electrical leads in the cord 48 is attached. Therefore when the plug 64 is received in the opening 62, the contacts 68 and 70 become connected to the leads in the cord 48 and so to the vehicle's electrical supply if the plug 50 is in place in the cigar lighter of the vehicle.

Figure 3:
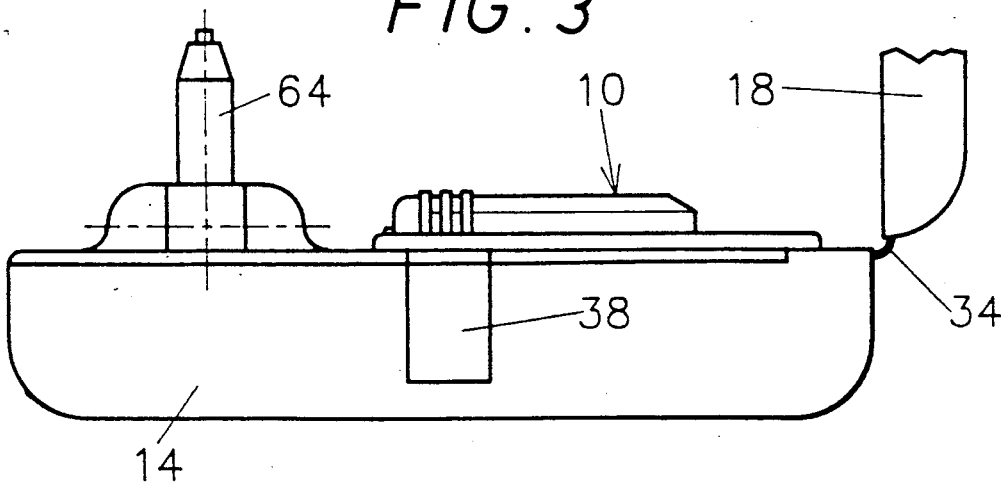
FIG. 3 is a side view, with the lid broken away, showing the case open and the light fitting removed.
Figure 2:
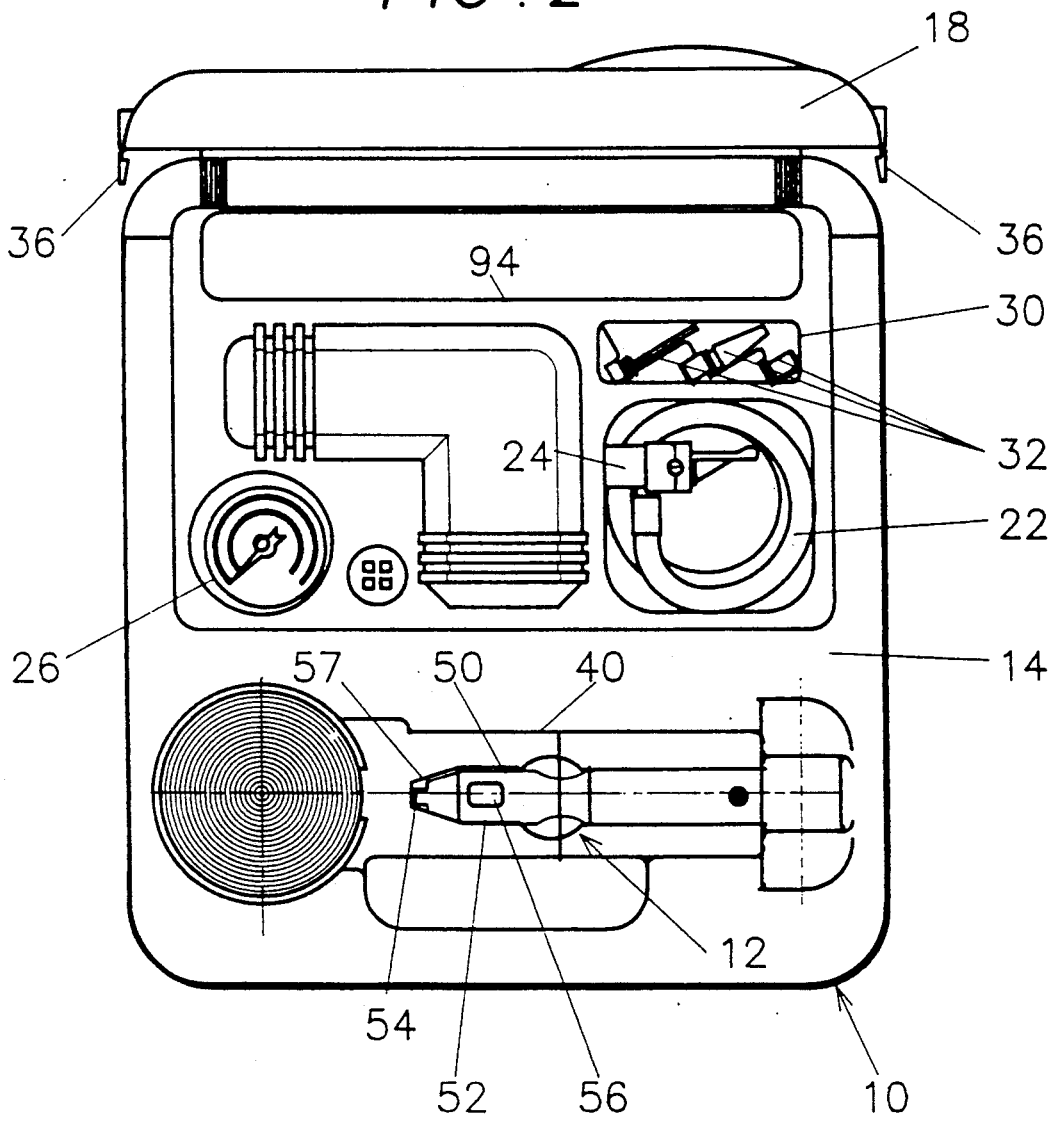
FIG. 2 is a view similar to FIG. 1 but showing the lid of the case opened and the orientation of the lamp reversed.

At its lower or inner end, the portion 66 of the plug 64 has a pair of integrally formed fingers 80. These are received and rotatably supported in a respective pair of bearings 82 formed in the case 14. The plug 64 is therefore hinged to the case and can move in the direction of the arrow 84 (FIG. 4) between an upright position shown in FIGS. 3 and 7 and a flat stored position as shown in FIGS. 1 and 2.

Figure 4:
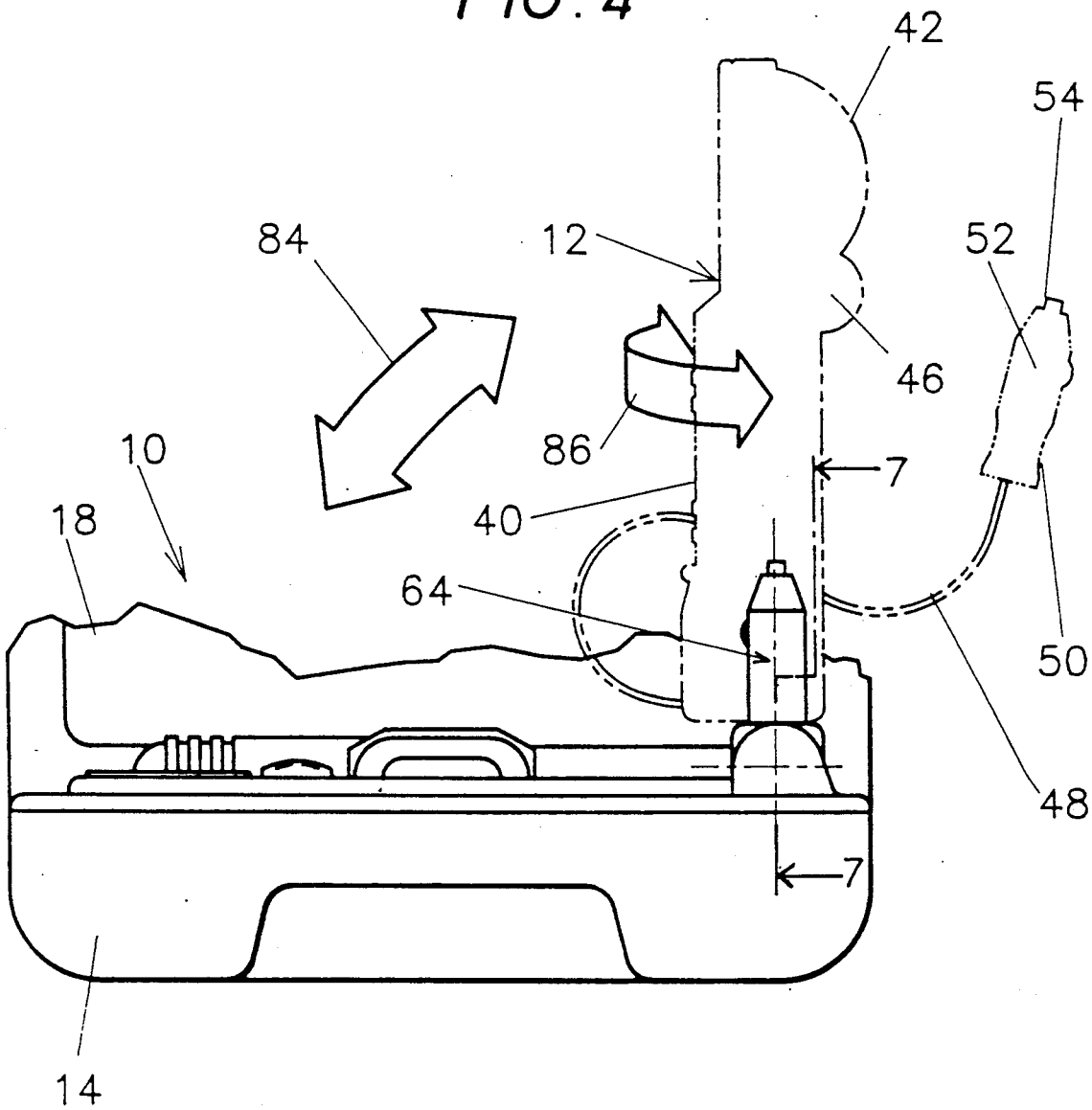
FIG. 4 is an end view, with the lid broken away, showing the light fitting in place and erected.

The opening 62 is of a size such that the lamp 12 is a secure fit on the plug 64. Therefore the lamp 12 is securely held to the case 14 when in the stored position shown in FIGS. 1 and 2 and alternatively can be securely supported in an upright position as shown in FIG. 4 to provide fixed illumination, the case providing a support for the light and the light being capable of being twisted about the plug 64 in the direction of the arrow 86 (FIG. 4) to illuminate a desired area whilst leaving the hands of a user free. Thus for example the light could illuminate the area of a tire whilst the user is using the compressor 16 to re-inflate a tire.

As best seen in FIGS.. 6 and 7, attached to the contacts 68 and 70 are a pair of electrical wires 88 and 90, respectively, which are joined to the motor 28. An on/off switch 92 can also be provided in the case to control the operation of the motor 28.

Therefore, when the light 12 is attached to the plug 64, the compressor can be operated, provided of course that the plug 50 is itself connected to the vehicle's electrical supply as has been described.

An extra length of electrical cord (not shown) can be provided and stored in a compartment 94 in the case 14. This extra lead will have a plug identical to the plug 50 at one end and a socket similar to the lower end of the portion 40 at the other end. Then this extra length of cord can be attached between the light 12 and the plug 64 so that the light can be used remotely from the case whilst still powering the compressor 16.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A portable compressor of the type comprising:

an electrically powered compressor, an air hose for the compressor, a case housing said compressor and air hose, a portable light fixture comprising a hand-held portion and a head portion housing the light, said hand-held portion including an outlet socket, a length of electrical cords permanently attached to said light fixture, said length having a free end, an electrical plug attached to said free end of said cord for connection to the electrical system of a vehicle to draw power therefrom, and a hinged arm attached to said case and capable of folding flat within the case when the case is to be shut and being upstanding to support said portable light fixture, said hinged arm having a free end comprising an electrical plug capable of being received in said socket of the portable light fixture both to fix and support said light fixture on the end of said arm and to electrically connect said light fixture to said case.

2. A portable compressor according to claim 1 in which said electrical plugs each comprise a cylindrical shaped insulating body, a front end of said body, a resiliently depressible central contact at said front end constituting a first electrical contact, and a resiliently depressible side contact extending substantially radially out from said body to constitute a second electrical contact.

3. A portable compressor according to claim 1 in which said case is of rectangular parallelopiped shape, said compressor being permanently fitted with said case and said hinged arm being capable of being laid flat when said case is to be shut, said case having a hinged lid to protect said compressor when not in use.

4. A portable compressor of the type comprising:

an electrically powered compressor, an air hose for the compressor, a case housing said compressor and air hose, a portable light fixture comprising a hand-held portion and a head portion housing the light, said hand-held portion including an outlet socket, a length of electrical cords permanently attached to said light fixture, said length having a free end, an electrical plug attached to said free end of said cord for connection to the electrical system of a vehicle to draw power therefrom, and a hinged arm attached to said case and capable of folding flat within the case when the case is to be shut and being upstanding to support said portable light fixture, said hinged arm having a free end comprising an electrical plug capable of being received in said socket of the portable light fixture both to fix and support said light fixture on the end of said arm and to electrically connect said light fixture to said case, an additional length of electrical cord wherein one end contains a socket configured to receive the plug on the end of the arm hinged to the case, and the other end contains a plug receivable in the socket of the hand-held portion of the portable light so that the light can be used remotely from the compressor while the compressor is still powered.

5. A portable compressor according to claim 4 wherein the hinged arm consists essentially of the electrical plug and a pair of integrally formed fingers receivable in complementary bearings formed in the case, the fingers and bearings cooperating to securely mount the socket to the case while permitting the socket to pivot in one direction.

6. A portable compressor according to claim 4 in which said head of said light is hinged to said hand-held portion of said light.

* * * * *